US009548033B2

(12) United States Patent
Kim et al.

(10) Patent No.: US 9,548,033 B2
(45) Date of Patent: Jan. 17, 2017

(54) LIQUID CRYSTAL DISPLAY AND METHOD FOR DRIVING THE SAME

(71) Applicant: Samsung Display Co., Ltd., Yongin (KR)

(72) Inventors: Hun-Tae Kim, Asan-si (KR); Yun Jae Park, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 28 days.

(21) Appl. No.: 14/247,956

(22) Filed: Apr. 8, 2014

(65) Prior Publication Data

US 2015/0116373 A1 Apr. 30, 2015

(30) Foreign Application Priority Data

Oct. 25, 2013 (KR) ..... 10-2013-0128082

(51) Int. Cl.
*G09G 5/10* (2006.01)
*G09G 3/36* (2006.01)

(52) U.S. Cl.
CPC ..... *G09G 3/3648* (2013.01); *G09G 3/3614* (2013.01); *G09G 2320/0204* (2013.01); *G09G 2320/0219* (2013.01); *G09G 2320/0242* (2013.01)

(58) Field of Classification Search
CPC ..... G09G 2320/0242; G09G 5/06; G09G 2320/0219; G09G 2320/0233; G09G 2320/0285; G09G 3/3611; G09G 3/3614; G09G 3/36; G09G 3/3629; G09G 3/3659
See application file for complete search history.

(56) References Cited

U.S. PATENT DOCUMENTS

| | | | | |
|---|---|---|---|---|
| 7,062,105 | B2 * | 6/2006 | Funahashi | 382/274 |
| 7,567,229 | B2 | 7/2009 | Kasai et al. | |
| 2003/0011585 | A1 * | 1/2003 | Aoki | 345/211 |
| 2003/0231158 | A1 * | 12/2003 | Someya et al. | 345/101 |
| 2006/0176260 | A1 | 8/2006 | Koyama | |

(Continued)

FOREIGN PATENT DOCUMENTS

| | | |
|---|---|---|
| JP | 2001-201732 | 7/2001 |
| JP | 2006-189722 | 7/2006 |

(Continued)

*Primary Examiner* — Andrew Sasinowski
*Assistant Examiner* — Gerald Oliver
(74) *Attorney, Agent, or Firm* — H.C. Park & Associates, PLC

(57) ABSTRACT

The present invention relates to a liquid crystal display includes a liquid crystal display panel including a plurality of gate lines, a plurality of data lines, and a plurality of pixels, a gate driver connected to the plurality of gate lines and configured to apply a gate-on voltage, a data driver connected to the plurality of data lines and configured to apply a data voltage, and a signal controller configured to receive an image signal and controlling the gate driver and the data driver, wherein the signal controller is configured to generate two correction data for each image signal referring to two compensation lookup tables, and the two compensation lookup tables are provided to make absolute values of pixel voltages for each polarity substantially identical to each other with respect to the same gray scale value.

16 Claims, 8 Drawing Sheets

(56) References Cited

U.S. PATENT DOCUMENTS

| | | | | |
|---|---|---|---|---|
| 2007/0103420 | A1* | 5/2007 | Chao | G09G 3/3611 345/98 |
| 2008/0180374 | A1 | 7/2008 | Yoshimoto | |
| 2008/0284775 | A1* | 11/2008 | Shen et al. | 345/214 |
| 2011/0050754 | A1* | 3/2011 | Hyun | G09G 3/20 345/690 |
| 2012/0169720 | A1* | 7/2012 | Moh | H04N 13/0025 345/419 |
| 2012/0293476 | A1* | 11/2012 | Lee | 345/209 |
| 2013/0135366 | A1* | 5/2013 | Araki | 345/690 |
| 2013/0314395 | A1* | 11/2013 | Tsuei et al. | 345/212 |
| 2015/0022512 | A1* | 1/2015 | Ahn | G09G 3/3607 345/212 |
| 2015/0062190 | A1* | 3/2015 | Chang et al. | 345/690 |

FOREIGN PATENT DOCUMENTS

| | | |
|---|---|---|
| JP | 2009-037075 | 2/2009 |
| KR | 10-0121997 | 9/1997 |
| KR | 10-2007-0069311 | 7/2007 |
| KR | 10-2007-0095643 | 10/2007 |
| KR | 10-2008-0034573 | 4/2008 |
| KR | 10-0933456 | 12/2009 |
| KR | 10-1213945 | 12/2012 |

* cited by examiner

FIG.7

| | | | |
|---|---|---|---|
| A1 | A2 | ··· | An |
| B1 | B2 | ··· | Bn |
| ⋮ | ⋮ | ⋮ | ⋮ |
| X1 | X2 | ··· | Xn |

LIQUID CRYSTAL DISPLAY AND METHOD FOR DRIVING THE SAME

CROSS-REFERENCE TO RELATED APPLICATION

This application claims priority from and the benefit of Korean Patent Application No. 10-2013-0128082, filed on Oct. 25, 2013, which is hereby incorporated by reference for all purposes as if fully set forth herein.

BACKGROUND

Field

Exemplary embodiments of the present invention relate to a liquid crystal display and a driving method thereof.

Discussion of the Background

A liquid crystal display is one of the most common types of flat panel displays currently in use, and is a device that displays an image by changing alignment of liquid crystal molecules by forming an electric field with application of different potentials to a pixel electrode and a common electrode of a liquid crystal display panel and controlling the amount of light transmittance therethrough.

Since degradation occurs when the electric field of one direction is continuously applied to a liquid crystal material, polarity of a voltage applied to the pixel electrode is inverted with respect to polarity of a voltage applied to the common electrode to prevent occurrence of the degradation.

A thin film transistor is used as a switching element in the liquid crystal display panel, and parasitic capacitance generated between a gate electrode and a drain electrode of the thin film transistor causes generation of a kick-back voltage. The kick-back voltage distorts a voltage applied to the pixel electrode, and the voltage distortion due to the kick-back voltage is appeared in a drag-down direction regardless of polarity thereof, and the magnitude of the kick-back voltage, that is, a degree of voltage distortion, is different for each gray scale value.

Therefore, the kick-back voltage causes asymmetry between a valid voltage of positive polarity and a valid voltage of negative polarity of the pixel electrode, and this may cause a residual image, a flicker, crosstalk, and the like in display of an image in the liquid crystal display panel so that display quality of the liquid crystal display may be deteriorated.

The above information disclosed in this Background section is only for enhancement of understanding of the background of the invention and therefore it may contain information that does not form any part of the prior art nor what the prior art may suggest to a person of ordinary skill in the art.

SUMMARY

Exemplary embodiments of the present invention provide a liquid crystal display having excellent display quality, and a driving method thereof.

Exemplary embodiments of the present invention also provide a liquid crystal display that can compensate a kick-back voltage, and a driving method thereof.

Additional features of the invention will be set forth in the description which follows, and in part will be apparent from the description, or may be learned by practice of the invention.

An exemplary embodiment of the present invention provides a liquid crystal display, including a liquid crystal display panel including a plurality of gate lines, a plurality of data lines, and a plurality of pixels, a gate driver connected to the plurality of gate lines and configured to apply a gate-on voltage, a data driver connected to the plurality of data lines and configured to apply a data voltage and a signal controller configured to receive an image signal and control the gate driver and the data driver, wherein the signal controller is configured to generate two correction data for each image signal referring to two compensation lookup tables, and the two compensation lookup tables are provided to make absolute values of pixel voltages for each polarity substantially identical to each other with respect to the same gray scale value.

An exemplary embodiment of the present invention also provides a driving method of a liquid crystal display, including receiving an image signal by a signal controller, and generating two correction data for each image signal referring to two compensation lookup tables by the signal controller, wherein the two compensation lookup tables are provided to make absolute values of pixel voltages for each polarity substantially identical to each other with respect to the same gray scale value.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

FIG. 7 shows an exemplary method for compensating different kick-back voltages in each area of an exemplary liquid crystal display panel.

DETAILED DESCRIPTION OF THE ILLUSTRATED EMBODIMENTS

Figure 1:
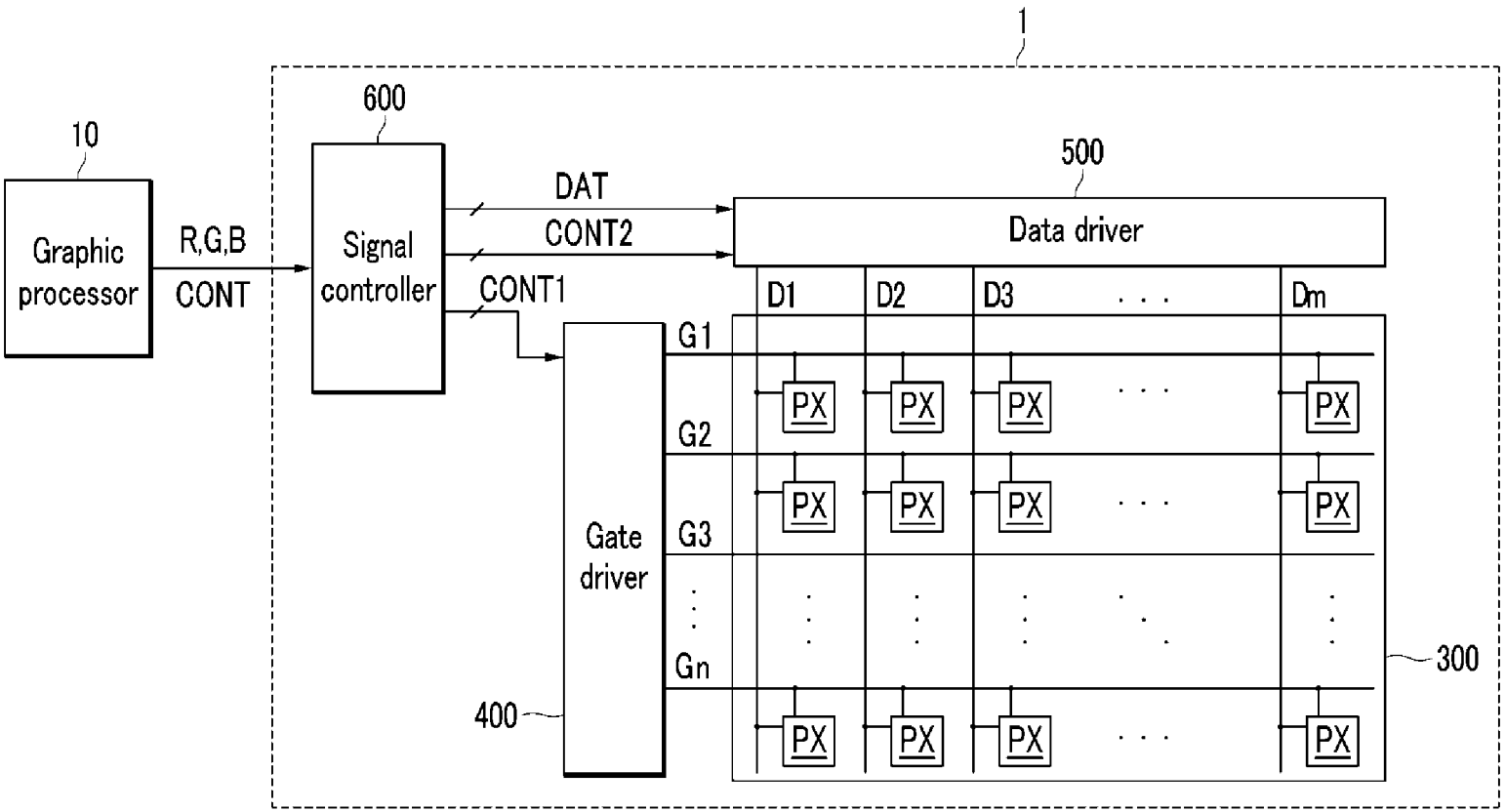
FIG. 1 is a block diagram of a liquid crystal display according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element or layer is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

A liquid crystal display according to an exemplary embodiment of the present invention, and a driving method thereof will be described with reference to the accompanying drawings.

Figure 2:
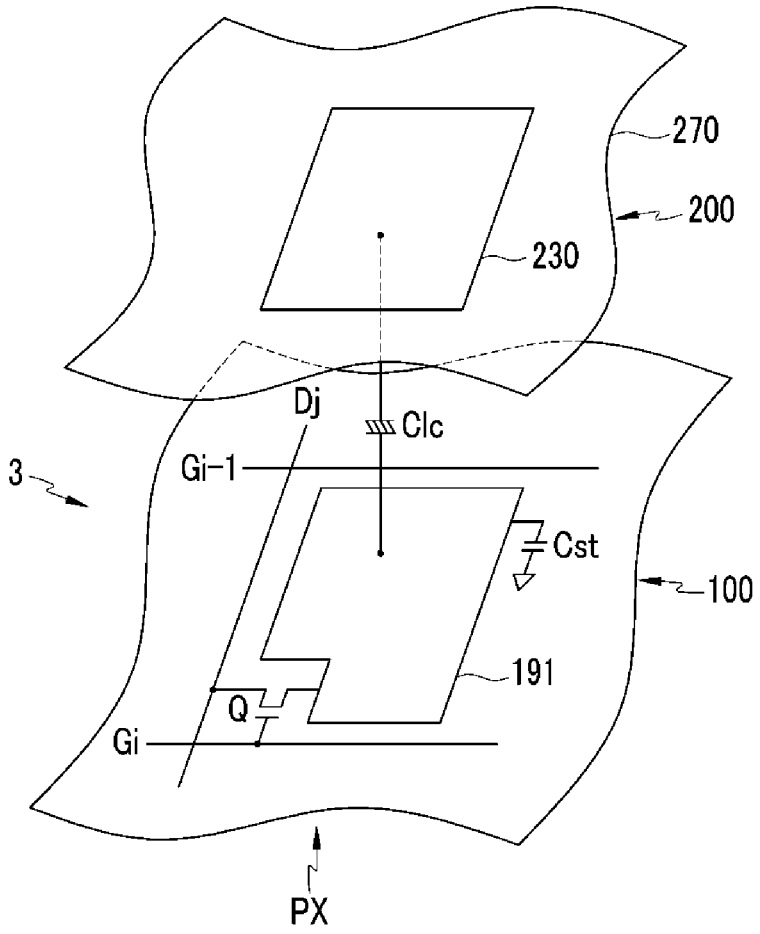
FIG. 2 is an equivalent circuit diagram in the liquid crystal display according to an exemplary embodiment of the present invention.

Referring to FIG. 1 and FIG. 2, a liquid crystal display according to an exemplary embodiment of the present invention will be described.

FIG. 1 is a block diagram of a liquid crystal display according to an exemplary embodiment of the present invention, and FIG. 2 is an equivalent circuit diagram of one pixel in the liquid crystal display according to an exemplary embodiment of the present invention.

As shown in FIG. 1, a liquid crystal display 1 includes a display panel 300 displaying an image, a gate driver 400, a data driver 500, and a signal controller 600. In FIG. 1, a graphics processor 10 provided at an external side of the liquid crystal display 1 is illustrated.

The graphics processor 10 provides image signals R, G, and B and a control signal CONT to the signal controller 600 of the liquid crystal display 1. The control signal CONT includes a horizontal synchronizing signal Hsync, a vertical synchronization signal Vsync, a clock signal CLK, and a data enable signal DE. The image signals R, G, and B and the control signal CONT may be transmitted to the signal controller 600 using, for example, a low voltage differential signaling (LVDS) method.

The liquid crystal display panel 300 includes lower and upper panels 100 and 200 that face each other, and a liquid crystal layer 3 disposed between the lower and upper panels 100 and 200. The liquid crystal display panel 300 includes a plurality of gate lines G1 to Gn and a plurality of data lines D1 to Dm. The plurality of gate lines G1 to Gn are substantially extended in a horizontal direction, and the plurality of data lines D1 to Dm are substantially extended in a vertical direction while crossing the gate lines G1 to Gn in an insulated manner.

One gate line and one data line are connected with one pixel PX. The pixels PX are arranged in a matrix format, and each pixel PX may include a thin film transistor Q, a liquid crystal capacitor Clc, and a storage capacitor Cst. A control terminal of the thin film transistor Q may be connected to the corresponding gate line among the gate lines G1 to Gn, an input terminal of the thin film transistor Q may be connected to the corresponding data line among the data lines D1 to Dm, and an output terminal of the thin film transistor Q may be connected to the corresponding pixel electrode 191, which is a first side terminal of the liquid crystal capacitor Clc and a first side terminal of the storage capacitor Cst. A second side terminal of the liquid crystal capacitor Clc is connected to a common electrode 270, and a second side terminal of the storage capacitor Cst may receive a storage voltage. Depending on a type of the liquid crystal display panel 300, both of the pixel electrode 191 and the common electrode 270 may be provided in the lower panel 100.

A voltage charged in the pixel PX (hereinafter referred to as a pixel voltage) may be dropped when a level of the pixel voltage is changed to a gate-off voltage from a gate-on voltage, due to a parasitic capacitor (not shown) which is a capacitive coupling component between the gate lines G1 to Gn and the pixel electrode 191. The dropped voltage is called a kick-back voltage, and all kick-back voltages are dropped regardless of polarity. As a result, the kick-back voltage causes a residual image or a flicker appears in a screen of the liquid crystal display.

The signal controller 600 receives the input image signals R, G, and B and control signals CONT, including the horizontal synchronizing signal Hsync, the vertical synchronization signal Vsync, the clock signal CLK, and a data enable signal DE from the external graphics processor 10. The signal controller 600 processes the image signals R, G, and B according to an operation condition of the liquid crystal display panel 300 based on the image signals R, G, and B and the control signal CONT, and then generates and output image data DAT, a gate control signal CONT1, a data control signal CONT2, and a clock signal.

The signal controller 600 may generate two correction data using two compensation lookup tables with respect to one image signal R, G, and B in advance to compensate an asymmetry in the pixel voltage due to the kick-back voltage. One correction data may be applied to a pixel to which a positive data voltage is applied and the other correction data may be applied to a pixel to which a negative data voltage is applied.

The gate control signal CONT1 includes a start pulse vertical signal STV that instructs start of scanning and a clock pulse vertical signal CPV that becomes a reference in generation of the gate-on voltage Von. One output cycle of the start pulse vertical signal STV corresponds to one frame or a refresh rate. The gate control signal CONT1 may further include an output enable signal OE that may limit a duration time of the gate-on voltage Von.

The data control signal CONT2 includes a start pulse horizontal signal STH that instructs starting of the image data DAT transmission with respect to pixels in one row and a load signal TP that instructs application of the corresponding data voltage to the data lines D1 to Dm. The data control signal CONT2 may further include an inversion signal REV that inverts polarity of the data voltage with respect to the common voltage Vcom.

The plurality of gate lines G1 to Gn of the liquid crystal display panel 300 are connected with the gate driver 400, and the gate-on voltage Von is sequentially applied to the gate lines G1 to Gn according to the gate control signal CONT1 applied from the signal controller 600. A gate-off voltage Voff is applied to the gate lines G1 to Gn in a section where the gate-on voltage Von is not applied.

The plurality of data lines D1 to Dm of the liquid crystal display panel 300 are connected with the data driver 500, and the data driver 500 receives the data control signal CONT2 and the image data DAT from the signal controller 600. The data driver 500 converts the image data to a data voltage using a gray voltage generated from a gray voltage generator (not shown), and transmits the data voltage to the data lines D1 to Dm. The data voltage includes a data voltage of a positive polarity and a data voltage of a negative polarity with reference to the common voltage. The data voltage of the positive polarity and the data voltage of the negative polarity are alternately applied and inversely driven with reference to a frame and a row and/or column. Accordingly, the inverse driving may be classified into frame inversion, row inversion, column inversion (or line inversion), dot inversion, and the like.

Figure 3:
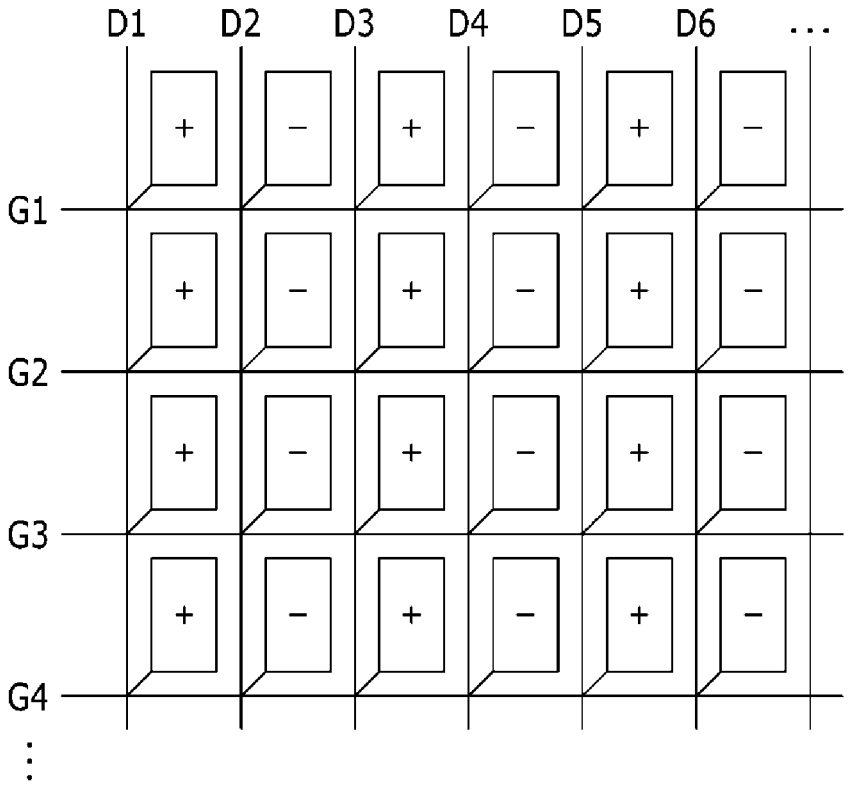
FIG. 3 shows a voltage relationship according to a polarity in relation to column inversion driving in the liquid crystal display according to an exemplary embodiment of the present invention.

FIG. 3 shows a voltage relationship according to polarity in relation to column inversion driving in the liquid crystal display according to the exemplary embodiment of the present invention.

The column inversion is a driving method of applying data voltages with identical polarity to a pixel column, wherein the polarity of data voltages is alternatively inverted for neighboring pixel columns, and polarity of each pixel column is inverted for each frame. For example, a positive data voltage is applied to odd-numbered pixel columns (D1, D3, D5, . . . ) and a negative data voltage is applied to even-numbered pixel columns (D2, D4, D6, . . . ) in one frame, and a negative data voltage is applied to odd-numbered pixel columns (D1, D3, D5, . . . ) and a positive data voltage is applied to even-numbered pixel columns (D2, D4, D6, . . . ) in the next frame.

Since the discordance in the polarity of pixel voltages caused by the kick-back voltage may cause luminance differences in each column, the column inversion driving may show a flicker and a moving vertical line compared to the dot inversion driving. However, since the column inversion does not invert the polarity for each row every frame, the column inversion may have relatively low power consumption and a relatively low temperature increase in the data driver.

Hereinafter, a method for compensating the asymmetry in pixel voltages due to the kick-back voltage in advance to thereby symmetrize the pixel voltages according to the exemplary embodiment of the present invention will be described in detail.

Figure 4:
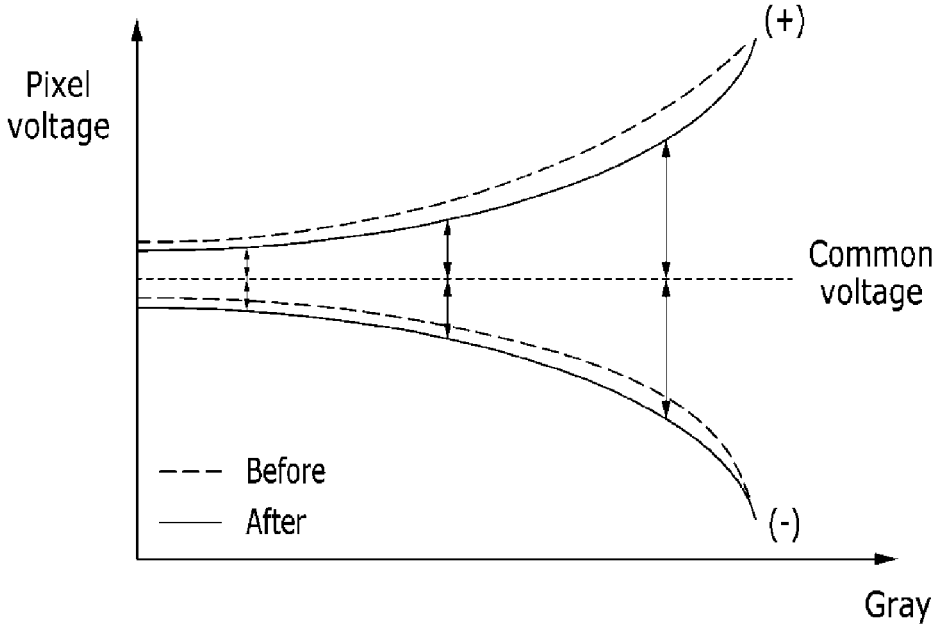
FIG. 4 is a graph illustrating a relationship between a common voltage and a pixel voltage in a liquid crystal device before and after application of the present invention.
Figure 5:
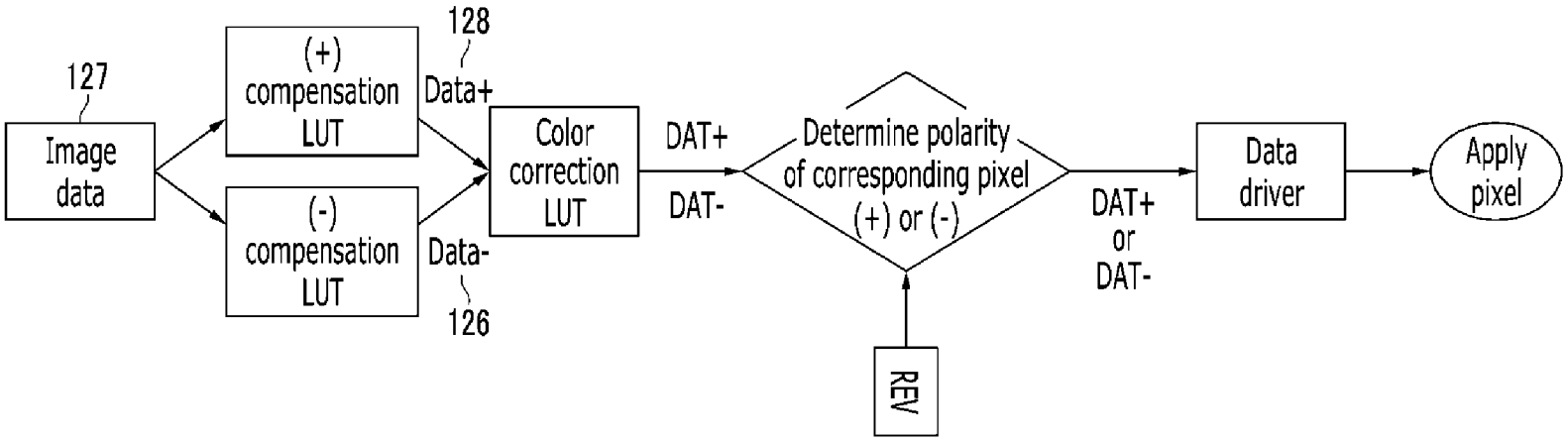
FIG. 5 is a flowchart illustrating a driving method for compensating a kick-back voltage of the liquid crystal display according to an exemplary embodiment of the present invention.
Figure 6:
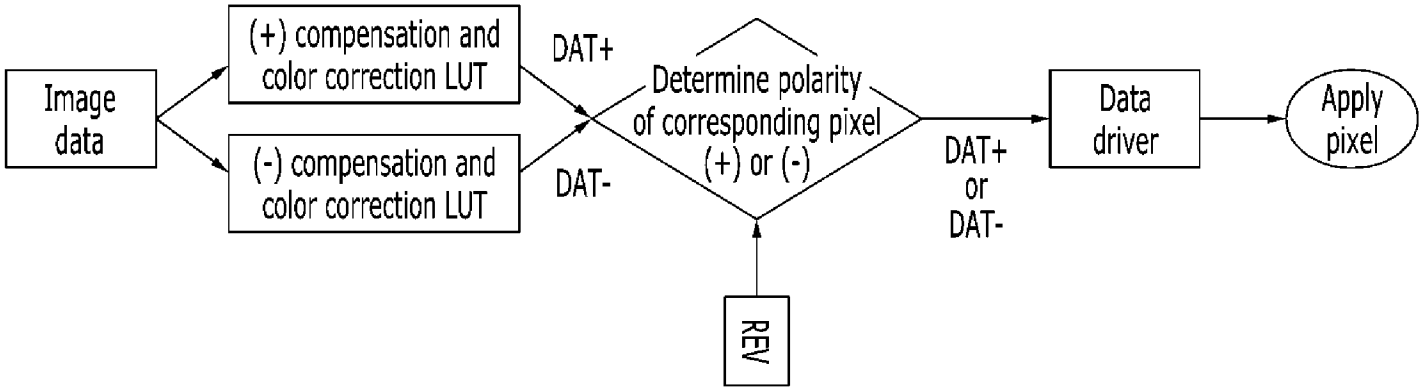
FIG. 6 is a flowchart of a driving method for compensating a kick-back voltage of a liquid crystal display according to another exemplary embodiment of the present invention.

FIG. 4 is a graph illustrating a relationship between a common voltage and a pixel voltage in the liquid crystal display before and after application of an exemplary embodiment of the present invention. FIG. 5 is a flowchart illustrating a driving method for compensating the kick-back voltage of the liquid crystal display according to an exemplary embodiment of the present invention. FIG. 6 is a flowchart of a driving method for compensating a voltage of a liquid crystal display according to another exemplary embodiment of the present invention.

When receiving the image signals R, G, and B from the external graphics processor 10, the signal controller 600 of the liquid crystal display may generate positive correction data Data+ and negative correction data Data− using a positive compensation lookup table and a negative compensation lookup table, respectively, with respect to the image signals.

Here, the positive correction data Data+ is data applied to a pixel to which a positive data voltage is to be applied, and the negative correction data Data− is data applied to a pixel to which a negative data voltage is to be applied. The positive and negative compensation lookup tables are provide to correct image data, e.g., gray scale values, in advance in consideration of an influence caused by the kick-back voltage. The compensation lookup tables can be made with respect to the all gray scale values in consideration of characteristics of the liquid crystal display panel.

According to an exemplary embodiment, the positive correction data Data+ or the negative correction data Data− may be generated using only one of the positive compensation lookup table or the negative compensation lookup table with respect to each of the image signals. In other words, the signal controller 600 may first determine whether an image signal is to be applied to a pixel to which a positive data voltage is applied or a pixel to which a negative data voltage is applied, and may generate single correction data using the appropriate compensation lookup table for the corresponding pixel. In this case, a data processing load may be reduced.

When a positive data voltage and a negative data voltage that represent the same gray scale value are applied to each pixel, the absolute values of the negative pixel voltage and the positive pixel voltage may be different due to the kick-back voltage. For example, an absolute value of the negative pixel voltage may be greater than an absolute value of the positive pixel voltage. One method of compensating the kick-back voltage may lower the common voltage in order to symmetrize the absolute value of positive pixel voltage and the negative pixel voltage with reference to the common voltage, such that pixel voltages of the two polarities in a specific gray scale value may have the same absolute value.

However, since the influence of the kick-back voltage is different in each gray scale value, the method of lowering the common voltage may make one pixel voltage symmetric with respect to one gray scale value, but it may not make other pixel voltages symmetric with respect to other gray scale values. In the exemplary embodiment of the present invention, on the other hand, the signal controller 600 performs a process to symmetrize pixel voltages of the two polarities with respect to the common voltage throughout all gray scale values (e.g., 0 to 255) as shown by the solid line of the graph of FIG. 4, rather than merely changing a level of the common voltage. However, exemplary embodiments of the present invention do not completely exclude the changing of the level of the common voltage.

The signal controller 600 generates correction data Data+ to be applied to a pixel to which a positive data voltage is applied and correction data Data− to be applied to a pixel to which a negative data voltage is applied using separate compensation lookup tables to symmetrize a positive pixel voltage and a negative pixel voltage with respect to the common voltage throughout all gray scale values (i.e., to make an absolute value of a positive pixel voltage and an absolute value of a negative pixel voltage equivalent to each other in each gray).

Referring to FIG. 5, with respect to the same gray scale value, the positive correction data Data+ and the negative correction data Data− may have different data values because they are generated using different lookup tables. For example, when the signal controller 600 receives an image data in gray scale 127, the signal controller 600 may output correction data Data+ in gray scale 128 using the positive compensation lookup table and may output compensation data Data− in gray scale 126 using the negative compensation lookup table.

The signal controller 600 generates positive correction image data DAT+ and negative correction image data DAT− using the generated positive correction data Data+ and the generated negative correction data Data−. A color correction lookup table relates to accurate color control (ACC) for expressing accurate colors of R, G, and B in accordance with characteristics of the liquid crystal display panel.

After generating the correction image data DAT+ and DAT−, the signal controller 600 determines a polarity of a data voltage to be applied to a pixel according to an inverse signal REV, and outputs positive correction image data DAT+ when the corresponding pixel has a positive polarity and outputs negative correction image data DAT− when the corresponding pixel has a negative polarity.

For example, referring to the column inversion of FIG. 3, in a specific frame, the signal controller 600 supplies positive correction image data DAT+ when charging the odd-numbered pixel columns D1, D3, D5, . . . with positive data voltages and supplies negative correction image data DAT− when charging the even-numbered pixel columns D2, D4, D6, . . . with negative data voltages. In the next frame, the polarity of the data voltage is inverted in every column, and therefore the signal controller 600 supplies negative correction image data DAT− for charging odd-numbered pixel columns D1, D3, D5, . . . and supplies positive correction image data DAT+ for charging even-numbered pixel columns D2, D4, D6, . . . .

When the positive correction image data DAT+ is received, the data driver 500 converts the corresponding data to a positive data voltage using a plurality of gray voltages having different levels for each gray scale value, and then applies the positive data voltage to the pixel through a data line. Likewise, when receiving the negative correction image data DAT−, the data driver 500 converts the corresponding data to a negative data voltage using a plurality of gray voltages having different levels for each gray scale value, and then applies the negative data voltage to the pixel through a data line. The positive correction image data DAT+ and the negative correction image data DAT− are symmetrically compensated in consideration of the asymmetry between a positive pixel voltage and a negative pixel voltage due to the kick-back voltage, and are results of correction of the input image signals R, G, and B using the positive and negative compensation lookup tables. Therefore, a positive pixel voltage and a negative pixel voltage may be symmetric with respect to image signals R, G, and B of the same gray scale value by applying data appropriate to polarity of each pixel.

Referring back to FIG. 4, the dotted line denotes a pixel voltage in a case that the data driver 500 receives one image data DAT regardless of polarity of pixels and applies data voltages to pixels only by changing the polarity of the data voltages, and the solid line denotes a pixel voltage in a case that the data driver 500 receives the positive and negative correction image data DAT+ and DAT− according to polarity of the corresponding pixel. In case of the dotted line, the positive pixel voltage and the negative pixel voltage are not symmetric with reference to the common voltage due to the influence of the kick-back voltage, but in case of the solid line, the influence of the kick-back voltage has been compensated by the positive and negative compensation lookup tables, and therefore the positive pixel voltage and the negative pixel voltage can be symmetric with respect to the common voltage throughout the entire gray scale values. In the drawing, guidelines with a pair of bidirectional arrows in the vertical direction indicates that a positive pixel voltage curve and a negative pixel voltage curve have the same distance from the common voltage.

In the exemplary embodiment of the present invention, the kick-back voltage can be actively compensated by adding only two lookup tables and setting using conditions of the tables without additional kick-back voltage compensation circuit or applying a physical change to the liquid crystal display.

Although it is not illustrated in FIG. 5, after application of the color correction lookup table, a response time improvement lookup table may be used to provide a dynamic capacitance compensation related to using an overshoot and an undershoot.

Referring to FIG. 6, the flow chart shows another exemplary embodiment in which a positive compensation lookup table and a negative compensation lookup table are incorporated with a color correction lookup table. That is, in the exemplary embodiment of FIG. 5, positive correction data Data+ and negative correction data Data− are respectively first generated using a positive compensation lookup table and a negative compensation lookup table with respect to input image signals R, G, and B, and then positive correction image data DAT+ and negative correction image data DAT− are respectively generated using a color correction lookup table with respect to the correction data. According to the present exemplary embodiment of FIG. 6, a color correction lookup table is made for each polarity so as to compensate the influence of the kick-back voltage in advance (i.e., a positive compensation and color correction lookup table and a negative compensation and color correction lookup table) without providing a compensation lookup table, and the input image signals R, G, and B are respectively converted directly to positive correction image data DAT+ and negative correction image data DAT− using the color correction lookup tables. Succeeding processes may be the same as those in the exemplary embodiment of FIG. 5. In other words, the signal controller 600 determines polarity of a data voltage to be applied to a pixel according to the inversion signal REV, and outputs the positive correction image data DAT+ or the negative correction image data DAT− according to polarity of the corresponding pixel. The data driver 500 receives correction image data of polarity that corresponds to the polarity of the pixel, converts the data to a data voltage of the corresponding polarity, and applies the data voltage to the corresponding pixel.

The exemplary embodiment of the present invention according to FIG. 6 may have decreased the number of lookup tables and steps, but it may have complicated composition of the lookup tables because compensation of the kick-back voltage and color correction should be simultaneously considered.

Referring to FIG. 7, it shows an exemplary method for compensating different kick-back voltages in each region of an exemplary liquid crystal display panel.

The liquid crystal display panel may have unique panel characteristics according to a manufacturing process. Specifically, a gamma characteristic which indicates a relationship between a gray scale value and luminance, may be determined according to a manufacturing process, and one region on a substrate may have different gamma characteristic from another. Accordingly, kick-back voltages may be different from one another according to the region on the substrate. Therefore, one liquid crystal display panel may be divided into a plurality of regions, and different compensation lookup tables may be applied to each region to realize more uniform image quality.

The large square shown in FIG. 7 represents the entire panel region. A region where a gamma deviation is greater than a predetermined value may be divided into blocks like A1, A2, and the like, and a positive compensation lookup table and a negative compensation lookup table set for each region in consideration of the gamma characteristics of each region may be applied to the corresponding region to compensate the kick-voltage in advance. In this case, a number of positive and negative compensation lookup tables may correspond to the number of divided regions.

Figure 8:
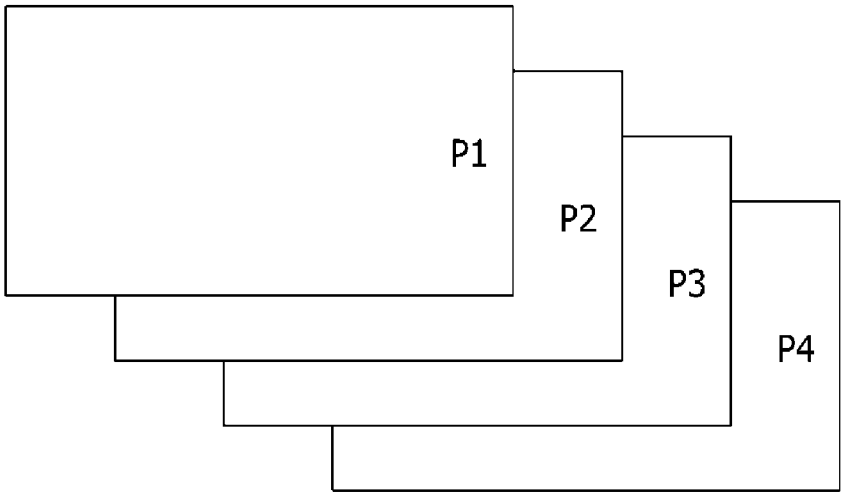
FIG. 8 shows a method for compensating different kick-back voltages between multiple liquid crystal display panels.

FIG. 8 shows a method for compensating different kick-back voltages between multiple liquid crystal display panels.

Even the liquid crystal display panels manufactured from same production line may have different gamma characteristics and each panel may have a different kick-back voltage. Therefore, different positive and negative compensation lookup tables may be applied to each panel. For example, positive and negative compensation lookup tables may be optimized to compensate for the kick-back voltage with respect to a liquid crystal display panel P1 that shows a gamma characteristic with a middle level in the process, and a plurality of positive and negative compensation lookup tables may be prepared by adjusting the optimized positive and negative compensation lookup tables with consideration of gamma characteristics between panels. Accordingly the kick-back voltage may be compensated in advance using compensation lookup tables appropriate for the respective panels P1, P2, P3, . . . , Pn) to realize the optimum image quality.

A plurality of compensation lookup tables maybe used with respect to one liquid crystal display panel. For example, the panel characteristics may change when the liquid crystal display panel is driven for a long period of time and the kick-back voltage characteristic may change accordingly. Therefore, when a certain driving time has passed, another compensation lookup table appropriate for a changed panel characteristic may be used instead of the initial compensation lookup table to thereby minimize deterioration of image quality according to use of the liquid crystal display.

The above-stated compensation lookup tables may be stored in a memory provided outside of a signal controller such as an EEPROM, and the signal controller may selectively use the tables according to conditions.

According to the present invention, display quality can be improved by compensating an influence caused by a kick-back voltage for each gray in advance. For example, it is possible to improve problems of visibility of a residual image, a flicker, a stain, and the like in a screen and crosstalk in realization of a 3D image of a shutter glass type of display.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display, comprising:

a liquid crystal display panel comprising a plurality of gate lines, a plurality of data lines, and a plurality of pixels, each of the plurality of pixels comprising a pixel electrode;

a gate driver connected to the plurality of gate lines and configured to apply a gate-on voltage;

a data driver connected to the plurality of data lines and configured to apply a data voltage; and a signal controller configured to receive an image signal and control the gate driver and the data driver, wherein the signal controller is configured to generate two correction image data for each image signal of a single frame by referring to two compensation lookup tables and output one of the two correction image data, and the data driver is configured to apply the data voltage based on the one of the two correction image data, wherein the two compensation lookup tables are provided to make absolute values of positive and negative pixel voltages substantially identical to each other with respect to the same gray scale value, and wherein the two compensation look up tables comprise a plurality of correction data for each gray scale value, each of the plurality of correction data configured to compensate for a voltage drop at a pixel electrode caused by a parasitic capacitance formed between the pixel electrode and the a corresponding gate line of the plurality of gate lines.

2. The liquid crystal display of claim 1, wherein each of the compensation lookup tables comprises data to generate correction image data with respect to all gray scale values of an image signal.

3. The liquid crystal display of claim 2, wherein the signal controller is configured to generate one correction image data to be applied to a pixel to which a positive data voltage is applied referring to one compensation lookup table, and generate another correction image data to be applied to a pixel to which a negative data voltage is applied referring to another compensation lookup table.

4. The liquid crystal display of claim 3, wherein the signal controller is configured to generate the two correction image data by further referring to a color correction lookup table.

5. The liquid crystal display of claim 4, wherein the signal controller is configured to determine polarity of a data voltage applied to a pixel, and provide the correction image data generated for a corresponding polarity of the pixel among the two correction image data to the data driver.

6. The liquid crystal display of claim 2, wherein the liquid crystal display panel comprises a plurality of regions, and the signal controller is configured to generate correction image data referring to a set of two compensation lookup tables among plurality of sets of two compensation lookup tables each set corresponding to a respective region of the plurality of regions.

7. The liquid crystal display of claim 2, further comprising a plurality of liquid crystal display panels, wherein the signal controller configured to generate correction image data referring to a set of two compensation lookup tables among a plurality of sets of two compensation lookup tables each set corresponding to a respective liquid crystal display panel of the plurality of liquid crystal display panels.

8. The liquid crystal display of claim 1, wherein the signal controller further comprises two color correction lookup tables and the two compensation lookup tables are respectively integrated into the two color correction lookup tables.

9. A driving method of a liquid crystal display, comprising:

receiving an image signal by a signal controller;

generating two correction image data for each image signal of a single frame by referring to two compensation lookup tables;

outputting one of the two correction image data by the signal controller; and applying a data voltage based on the one of the two correction image data by a data driver to a pixel electrode, wherein the two compensation lookup tables are provided to make absolute values of positive and negative pixel voltages substantially identical to each other with respect to the same gray scale value, and wherein the two compensation look up tables comprise a plurality of correction data for each gray scale value, each of the plurality of correction data configured to compensate for a voltage drop at the pixel electrode caused by a parasitic capacitance formed between the pixel electrode and the a corresponding gate line.

10. The driving method of the liquid crystal display of claim 9, wherein each of the compensation lookup tables comprises data to generate correction image data with respect to all gray scale values of the image signal.

11. The driving method of the liquid crystal display of claim 10, wherein the signal controller is configured to generate one correction image data applied to a pixel to which a positive data voltage is applied referring to one compensation look up table, and generate another correction image data applied to a pixel to which a negative data voltage is applied referring to another compensation lookup tables.

12. The driving method of the liquid crystal display of claim 11, wherein the generating the two correction image data further refers to a color correction lookup table.

13. The driving method of the liquid crystal display of claim 12, wherein the generating the two correction image data further comprises:

determining polarity of a data voltage applied to a pixel; and providing correction image data generated for a corresponding polarity of the pixel among the two correction image data to the data driver by the signal controller.

14. The driving method of the liquid crystal display of claim 10, wherein the liquid crystal display panel comprises a plurality of regions, and the signal controller is configured to generate correction image data referring to a set of two compensation lookup tables among plurality of sets of two compensation lookup tables each set corresponding to a respective region of the plurality of regions.

15. The driving method of the liquid crystal display of claim 10, wherein the liquid crystal display panel further comprising a plurality of liquid crystal display panels, and the signal controller is configured to generate the correction image data referring to a set of two compensation lookup tables among a plurality of sets of two compensation lookup tables each set corresponding to a respective liquid crystal display panel of the plurality of liquid crystal display panels.

16. The driving method of the liquid crystal display of claim 9, wherein the two compensation lookup tables are respectively integrated into two color correction lookup tables.

* * * * *